United States Patent [19]

Zieger

[11] 3,979,096

[45] Sept. 7, 1976

[54] MOUNTING ARRANGEMENT FOR HAND-HELD SHOWER HEAD

[75] Inventor: Claus D. Zieger, Covina, Calif.

[73] Assignee: Interbath, Inc., El Monte, Calif.

[22] Filed: Nov. 30, 1973

[21] Appl. No.: 420,608

[52] U.S. Cl. ..... 248/75; 4/145

[51] Int. Cl.[2] ..... B05B 15/06

[58] Field of Search ..... 248/75, 76, 229, 314; 239/588; 4/145, 159

[56] References Cited

UNITED STATES PATENTS

| | | | |
|---|---|---|---|
| 1,189,970 | 7/1916 | Kline | 4/145 |
| 1,327,428 | 1/1920 | Gregory | 239/588 |
| 1,512,581 | 10/1924 | Deming | 248/75 |
| 2,873,999 | 2/1959 | Webb | 248/75 |
| 2,966,311 | 12/1960 | Davis | 4/145 |
| 3,404,410 | 10/1968 | Sumida | 4/145 |

FOREIGN PATENTS OR APPLICATIONS

| | | | |
|---|---|---|---|
| 1,036,819 | 9/1953 | France | 4/145 |
| 127,473 | 3/1945 | Norway | 248/75 |

*Primary Examiner*—Roy D. Frazier
*Assistant Examiner*—Darrell Marquette
*Attorney, Agent, or Firm*—Rose & Edell

[57] ABSTRACT

A mounting arrangement for a hand-held shower head includes a bracket which is secured to the water supply pipe and a receiver which is pivotally mounted to the bracket so that its position may be adjusted in a plane extending parallel to the longitudinal axis of the supply pipe. The receiver is open along one side to permit a hose attachment for the shower head to be inserted into or removed from the receiver. The receiver is adapted to receive the shower head in a plurality of angularly related positions so that the horizontal direction of the spray may be adjusted. Vertical spray direction is adjustable by pivoting the receiver relative to the bracket.

6 Claims, 5 Drawing Figures

MOUNTING ARRANGEMENT FOR HAND-HELD SHOWER HEAD

BACKGROUND OF THE INVENTION

The present invention relates to mounting arrangements for hand-held shower heads and, more particularly, to such mounting arrangements which permit a shower head to be supported proximate a water supply pipe in substantially the same position as a permanently positioned shower head.

Hand-held shower heads are experiencing a surge in popularity. Such shower heads have many advantages and are convenient to use; however, prior art mounting arrangements for hand-held shower heads have a number of disadvantages. For example, most hand-held shower heads require mounting brackets which are secured to a wall and therefore require that mounting holes be drilled in the wall of the shower stall. Where the entire wall is tiled this disadvantage becomes a serious problem since quite often attempts to drill holes in the tile results in cracked tiles.

It is also desirable that shower heads of the hand-held type be capable of mounting as close to the water supply pipe as possible to thereby provide spray from a location proximate that of a conventionally mounted fixed shower head. The desirability of this position relates to the fact that shower stalls are generally designed to have the spray emanate from a specific location. If the spray emanates from other than that specific location, the bather is often unable to properly position himself within the stall to obtain optimum spray coverage. Moreover, spray emanating from other than the designed location often results in water being directed outside the stall.

There are a few prior art hand-held shower heads which are capable of being mounted directly on a shower plumbing fixture. However when so mounted, these prior art shower heads have limited spray direction adjustability. In some cases the spray direction may be adjusted in a horizontal plane. However, no prior art hand-held shower heads are capable of being mounted on the plumbing fixture in a manner to permit adjustment of spray direction in both horizontal and vertical planes.

It is therefore an object of the present invention to provide a mounting arrangement for a hand-held shower head which eliminates the need for a wall mounting bracket.

It is another object of the present invention to provide a mounting arrangement for a hand-held shower head which utilizes the existing plumbing fixture for mounting and permits the spray direction of the mounted shower head to be adjusted in two planes.

SUMMARY OF THE INVENTION

According to the present invention a bracket is secured to the water supply pipe either by means of threaded engagement to the pipe or by clamping. A shower head receiver is pivotally mounted to the bracket for rotation in a plane extending parallel to the longitudinal axis of the water supply pipe. By so rotating the receiver, the direction of the spray emanating from the mounted shower head is adjusted in a vertical plane. The engagement between the receiver and the shower head is such that the shower head is rotatable within the receiver to thereby permit adjustment of the horizontal spray direction.

BRIEF DESCRIPTION OF THE DRAWINGS

Further objects, features and advantages of the present invention will become apparent upon consideration of one specific embodiment thereof especially when taken in conjunction with the accompanying drawings, wherein.

DESCRIPTION OF THE PREFERRED EMBODIMENT

Figure 1:
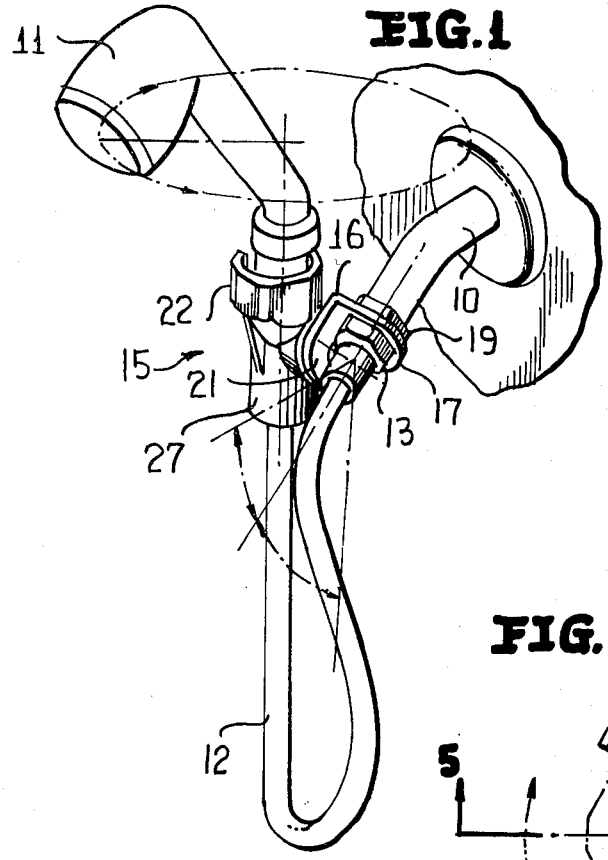
FIG. 1 is a view in perspective of the mounting arrangement of the present invention installed on a plumbing fixture and having a hand-held shower mounted therein.
Figure 2:
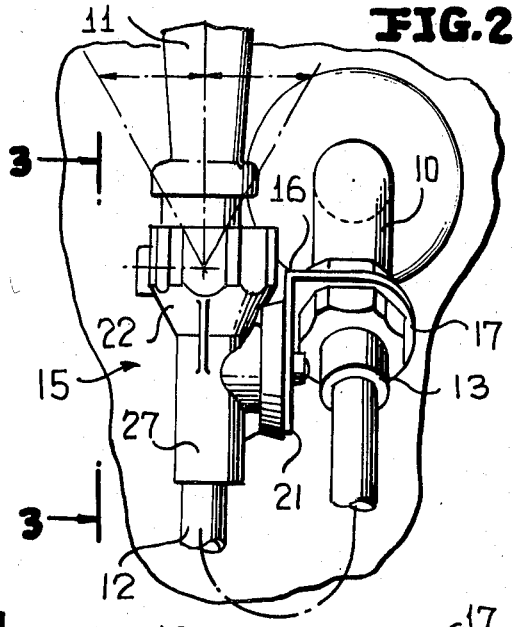
FIG. 2 is a partial front view in plan of the installation illustrated in FIG. 1.
Figure 4:
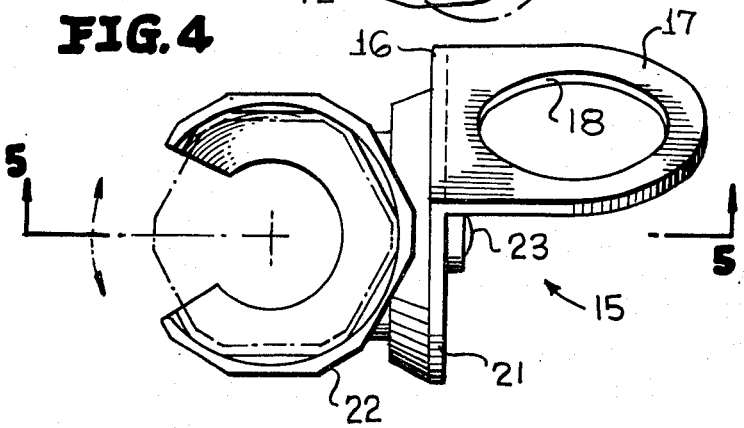
FIG. 4 is a top view in plan of the mounting arrangement of the present invention.
Figure 3:
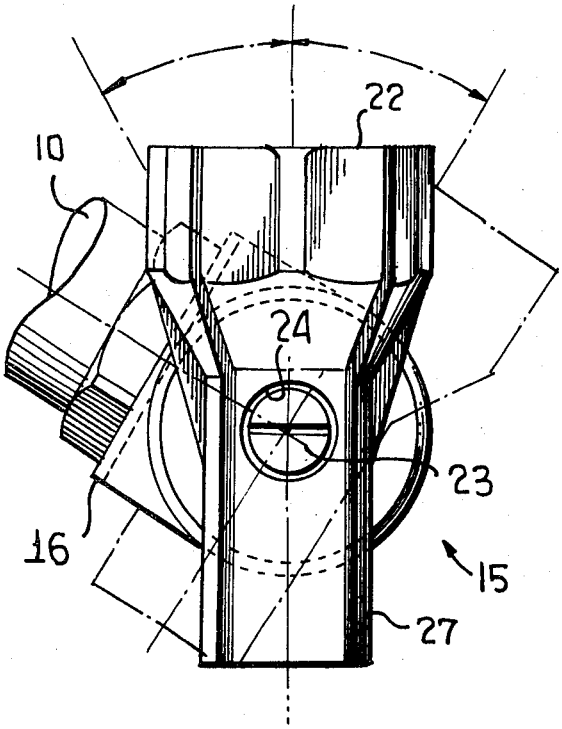
FIG. 3 is a side view in plan taken along the lines 3—3 in FIG. 2.
Figure 5:
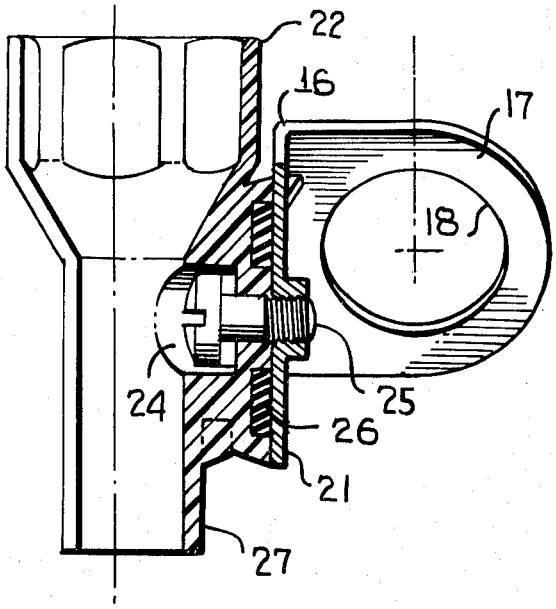
FIG. 5 is a plan view in section taken along lines 5—5 of FIG. 4.

Referring specifically to FIGS. 1 and 2 of the accompanying drawings, a plumbing installation in a shower stall includes a water supply pipe 10 which is threaded at its end (not visible in FIGS. 1 and 2) in the usual manner to engage a standard shower head. A shower head 11 of the hand-held type is illustrated as being connected to one end of a supply hose 12 for purposes of receiving water therefrom. The other end of hose 12 contains suitable means 13 for threadedly engaging the threaded end of water supply pipe 10.

The shower head 11 is shown mounted in the mounting arrangement 15 of the present invention. Specifically, and referring to all of the figures of the accompanying drawings, mounting arrangement 15 includes a small L-bracket 16 having one leg 17 through which an aperture 18 is defined. Aperture 18 is adapted to fit over supply pipe 10 and be secured thereto between an internally threaded nut 19 and threaded termination means 13 for supply hose 12. In this manner L-bracket 16 is secured in place with its other leg 21 extending generally in the direction of outflow from supply pipe 10. This manner of securing bracket 16 to supply pipe 10 is by no means a limiting feature of the present invention. Specifically, bracket 16 may be clamped or otherwise secured to the supply pipe without the need for aperture 18 and nut 19.

A receiver 22 is pivotally secured to leg 21 of L-bracket 16 on the surface of leg 21 which is remote from supply pipe 10. This pivotal engagement may take substantially any known form but is illustrated herein as comprising a screw 23 extending through a suitably provided aperture 24 in receiver 22 to threadedly engage a threaded aperture in leg 21 of the L-bracket. The surface of receiver 22 which abuts bracket leg 21 is recessed to receive an O-ring 26 which provides frictional engagement between the abutting surfaces of the receiver and bracket. O-ring 26 thus maintains the receiver 22 in whatever pivotal position it is placed relative to bracket 21.

Receiver 22 has a generally funnel-like configuration which is open along its entire length on one side. This open side is illustrated in the drawings as being located on the side remote from supply pipe 10; this permits the user to rotate the receiver by merely pulling or pushing on shower head 11. The open side could also be located at the front or rear of receiver 22, in which case more care would be required in pivoting the receiver.

The stem 27 of the funnel-like receiver is substantially cylindrical inside and out, except of course for its open side. The internal diameter of stem 27 is sufficiently large to receive supply hose 12. The upper portion of receiver 22 is configured to receive the base of shower head 11 before tapering towards stem 27. In the specific embodiment illustrated in the drawings, the assumption is made that the base of the shower head 11 is connected to a hexagonal nut; consequently the upper portion of receiver 22 has a generally hexagonal interior configuration adapted to receive the hexagonal nut at the shower head base. In this manner, shower head 11 may be rotated to six discrete positions in the horizontal plane as illustrated by the elliptical arrow path in FIG. 1. It is to be understood that if the base portion of shower head 11 is circular, the interior configuration of the upper portion of receiver 22 would also be circular. For such circular configuration, adjustment of the spray direction in the horizontal plane is possible over a continuous range of positions as opposed to the discrete positional adjustment capability provided by the hexagonal interior configuration of receiver 22.

The interior taper in receiver 22 serves to support shower head 11 within the receiver. To this end, the longitudinally extending opening along the side of receiver 22 is sufficiently small to prevent the base of shower head 11 from fitting through the open side. Since hose 12 is of substantially smaller diameter than the base of the shower head, removal and insertion of the shower head from receiver 22 is effected by passing hose 12 through the open receiver side. Thus, to remove the shower head from receiver 22 it need only be lifted so that hose 12 is aligned with the open receiver side; the hose is then passed through the receiver side. Insertion of the shower head into the receiver requires that the hose be passed back through the open receiver side and the shower head lowered so that its base is engaged by the upper portion of the receiver.

The essence of the invention as described herein is a mounting arrangement for a hand-held shower which can be secured directly to the water supply pipe of a shower plumbing fixture and permits both vertical and horizontal adjustment of the shower spray direction. Within that frame work numerous variations of the specific embodiment disclosed herein are possible. Positional adjustment of spray direction in a horizontal plane may be looked upon as rotating the shower head 11 about a first imaginary axis which extends generally along the shower head arm, perpendicular to the direction of spray and in a generally vertical plane. Vertical adjustment of spray direction may be looked upon as rotating the shower head 11 about a second imaginary axis extending perpendicular to both the first imaginary axis and the spray direction and lying in a generally horizontal plane.

Although the material used for the various parts of the mounting arrangement are not critical, I have found that the use of stainless steel for bracket 16 and water-resistant rigid plastic for the receiver is advantageous.

While I have described and illustrated one specific embodiment of my invention it will be clear that variations of the details of construction which are specifically illustrated and described may be resorted to without departing from the true spirit and scope of the invention as defined in the appended claims.

I claim:

1. In a shower installation of the type having a rigid water supply pipe with an outlet from which pressurized water can be supplied to a shower head via a flexible hose which attaches to the supply pipe outlet and has insufficient rigidity of itself to support said shower head in an operable position, wherein said shower head is of the type which receives pressurized water at one end from said hose and issues the pressurized water from its opposite end after re-directing the water flow direction internally of the shower head, a mounting arrangement for said shower head, comprising:

a support member of regular polygonal periphery secured to said shower head proximate said one end thereof;

a bracket member having an apertured leg and a further leg oriented perpendicular to said apertured leg, means for fixedly securing said apertured leg to supply pipe with the supply pipe extending through the apertured leg such that said apertured leg is perpendicular to said supply pipe and said further leg is parallel to and spaced from said supply pipe;

a receiver member; and means for rotatably securing said receiver member to said further leg to permit operator-initiated rotation of said receiver member relative to said bracket member about a single axis extending perpendicular to said further leg;

said receiver member including a hollow member having an opening at least as wide as the diameter of said flexible hose extending along the entire length of one of its sides, said hollow member having: a first longitudinally-extending section having a regular polygonal internal cross-section which matches but is slightly larger than the regular polygonal periphery of said support member; and a second longitudinally-extending section having a cross-section which is smaller than the support member periphery and larger than the circumference of said hose; whereby, upon positioning said support member in said first longitudinally-extending section said hollow member is capable of removably holding said shower head in a plurality of different rotational positions of said shower head about a second axis, said second axis being generally perpendicular to said single axis.

2. The mounting arrangement according to claim 1 wherein said support member is a plumbing fitting having a hexagonal configuration and the interior walls of said first longitudinally-extending section define a matching hexagonal shape.

3. The mounting arrangement according to claim 2 wherein said bracket member is an L-bracket.

4. The mounting arrangement according to claim 3 wherein said means for rotatably securing comprises a screw member joining said bracket further leg and receiver member along abutting surfaces, and means for frictionally engaging said abutting surfaces to one another.

5. The mounting arrangement according to claim 1 wherein said bracket member is an L-bracket.

6. The mounting arrangement according to claim 1 wherein said means for rotatably securing comprises a screw member joining said further leg and receiver member along abutting surfaces, and means for frictionally engaging said abutting surfaces to one another.

* * * * *